US005940921A

United States Patent [19]

Wood et al.

[11] Patent Number: 5,940,921

[45] Date of Patent: Aug. 24, 1999

[54] APPLICATOR FOR A CORELESS TAPE ROLL

[75] Inventors: Thomas L. Wood, Maplewood; Raymond D. Zachrison, Lindstrom, both of Minn.

[73] Assignee: Minnesota Mining and Manufacturing Company, St. Paul, Minn.

[21] Appl. No.: 09/024,064

[22] Filed: Feb. 17, 1998

Related U.S. Application Data

[63] Continuation-in-part of application No. 08/810,150, Feb. 25, 1997, abandoned.

[51] Int. Cl.[6] ..... A47L 25/00

[52] U.S. Cl. ..... 15/104.002; 15/230.11; 492/13

[58] Field of Search ..... 15/104.002, 27, 15/230.11; 492/13, 14, 19

[56] References Cited

U.S. PATENT DOCUMENTS

| | | | |
|---|---|---|---|
| D. 247,143 | 2/1978 | Rivas | D4/137 |
| D. 273,058 | 3/1984 | McKay | D4/122 |
| D. 273,059 | 3/1984 | McKay | D4/122 |
| D. 276,763 | 12/1984 | McKay | D4/122 |
| D. 295,833 | 5/1988 | Roth | D9/337 |
| 2,401,842 | 6/1946 | Slater | 15/104.002 |
| 2,702,913 | 3/1955 | Walkama | 15/104.002 |
| 2,724,847 | 11/1955 | Krasno | 15/104.002 |
| 3,013,367 | 12/1961 | Sarre | 53/520 |
| 3,201,815 | 8/1965 | Selby | 15/104.002 |
| 3,231,918 | 2/1966 | Marks | 15/104.002 |
| 3,299,461 | 1/1967 | Marks | 15/104.002 |
| 3,342,325 | 9/1967 | Dreher | 206/400 |
| 3,343,194 | 9/1967 | Ramelson | 15/104.002 |
| 3,363,276 | 1/1968 | Thomas, Jr. | 15/105 |
| 3,389,416 | 6/1968 | Timms | 15/104.002 |
| 3,417,418 | 12/1968 | Riboud | 15/104.002 |
| 3,421,170 | 1/1969 | Thomas, Jr. | 15/104.002 |
| 3,623,179 | 11/1971 | Roth | 15/104.002 X |
| 3,742,547 | 7/1973 | Sohmer | 15/104.002 |
| 3,770,542 | 11/1973 | Hall et al. | 156/184 |
| 3,823,887 | 7/1974 | Gerstein | 242/521 |
| 3,899,075 | 8/1975 | Hall et al. | 206/411 |
| 4,297,403 | 10/1981 | Smith | 428/42.3 |
| 4,361,923 | 12/1982 | McKay | 15/104.002 |
| 4,399,579 | 8/1983 | McKay | 15/104.002 |
| 4,422,201 | 12/1983 | McKay | 15/104.002 |
| 4,427,726 | 1/1984 | Wolfrum | 428/43 |
| 4,570,280 | 2/1986 | Roth | 15/104.002 |
| 4,727,616 | 3/1988 | Kucera et al. | 15/104.002 |
| 4,783,015 | 11/1988 | Shimizu | 242/160.1 |
| 4,807,825 | 2/1989 | Elsner et al. | 242/524 |
| 5,027,465 | 7/1991 | McKay | 15/104.002 |
| 5,388,300 | 2/1995 | Hickey | 15/104.002 |

FOREIGN PATENT DOCUMENTS

| | | |
|---|---|---|
| 1402540 | 12/1965 | France . |
| 8421443 | 11/1985 | Germany . |
| 8804854 | 5/1988 | Germany . |

OTHER PUBLICATIONS

*Encyclopedia of Polymer Science and Engineering,* vol. 13, Wiley–Interscience Publishers (New York, 1988).

*Encyclopedia of Polymer Science and Technology,* vol. 1, Interscience Publishers (New York, 1964).

*Primary Examiner*—Mark Spisich

*Attorney, Agent, or Firm*—Charles D. Levine

[57] ABSTRACT

An applicator for a lint removal device includes a handle portion connected to a tape-receiving portion. The tape-receiving portion includes a tape-receiving surface, an inner lip, an outer lip, and grooves adjacent the lips. The outer lip is tapered. After a roll of tape traverses over the outer lip it is locked in place on the tape-receiving surface and cannot be removed by sliding it back over the outer lip.

10 Claims, 3 Drawing Sheets

APPLICATOR FOR A CORELESS TAPE ROLL

This application is a continuation-in-part of U.S. application Ser. No. 08/810,150, filed Feb. 25, 1997, abandoned.

TECHNICAL FIELD

The present invention relates to an applicator for tape rolls. More particularly, the present invention relates to an applicator for tape rolls used for lint removal.

BACKGROUND OF THE INVENTION

Most rolls of tape are used by first removing a length of tape from the roll before using the tape for its intended purpose. One use for tape while still on a roll is lint removal. Lint removal tape is used to remove lint and other small particles from fabric, such as clothing. Lint removal tape can be used in individual sheets, whether individually packaged or removed from a roll or a pad. Lint removal tape can also be used while in roll form with the tape still on the roll. The tape is removed from the roll only after use, to discard it.

In roll form, lint removal tape is typically wound on a core with the adhesive side of the tape wound outwardly for use. A roll of lint removal tape is placed on an applicator, which typically is formed of a handle portion and a tape-receiving portion. The roll is placed on the tape-receiving portion. Various forms of lint removal tape rolls are known, such as those described in U.S. Pat. No. 5,027,465 and U.S. Pat. No. 5,388,300.

Coreless rolls of tape and methods for their manufacture are known. For example, U.S. Pat. Nos. 3,770,542 and 3,899,075 disclose coreless tape rolls. The tape rolls formed, however, are linered and the liner performs the functions of a core.

U.S. Pat. No. 4,297,403 discloses another linered coreless roll of tape. In order to use this roll, the innermost portions of tape are not useable and must be discarded.

U.S. Pat. No. 3,823,887 discloses a method of winding thin tissue paper into a roll without a core. However, there is no suggestion of how such a coreless roll of thin paper could be used. Also, this roll is free of adhesive or similar substances.

Also, generally, these known coreless rolls are used by removing a portion of tape from the roll before using the tape for its intended purpose. There are no known coreless rolls of tape in which the tape is used while it is still on the roll, and the tape is removed from the roll only after use, to discard it. There is a need for a linerless, coreless roll of tape in which all of the tape is usable, the tape is used while it is still on the roll, and the tape is removed from the roll only after use, to discard it.

SUMMARY OF THE INVENTION

An applicator for use with a lint removal tape includes a handle portion and a tape-receiving portion, each having a free end and a connecting end. The handle portion connecting end is connected to the tape-receiving portion connecting end. The tape-receiving portion includes a cylindrical tape-receiving surface, an inner lip adjacent the handle portion, and an outer lip adjacent the free end. The outer lip extends radially beyond the tape-receiving surface, and is tapered in a direction to facilitate applying a roll on the applicator. A groove is formed adjacent the outer lip on the side facing the handle portion, and combines with the outer lip to lock a roll of tape on the tape-receiving surface. After a roll of tape traverses over the outer lip it is locked on the tape-receiving surface and cannot be removed by sliding it back over the outer lip without permanent damage to the tape-recieving portion of the applicator.

The outer lip can be substantially inflexible such that in order for the tape-receiving surface to receive a roll of tape that is slid over the lip on the free end, the roll of tape would need to be flexible.

The outer lip can be perpendicular to the tape-receiving portion on the side facing the handle portion. The applicator can be blow molded and formed of a one piece construction and the handle portion can be contoured to ergodynamically fit a hand. Also, the handle portion can have an opening at the free end to permit hanging the handle on a hook.

DETAILED DESCRIPTION

Figure 1:
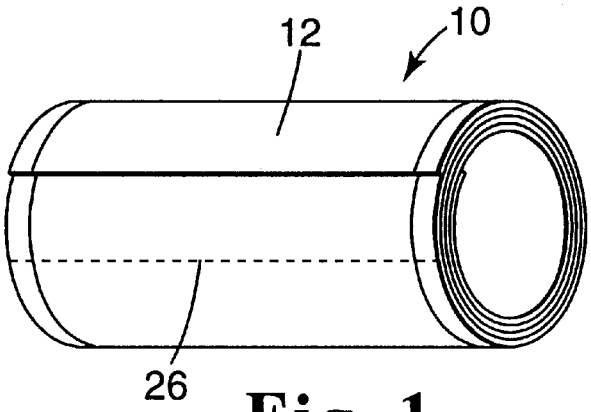
FIG. 1 is a perspective view of a roll of tape of the present invention.
Figure 2:
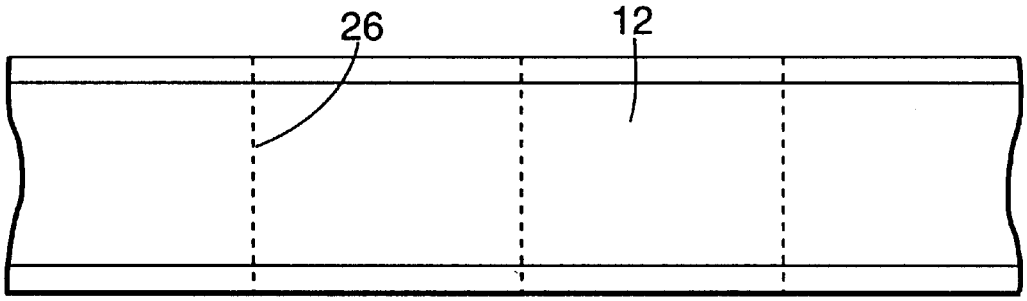
FIG. 2 is a top view of a portion of tape.
Figure 3:
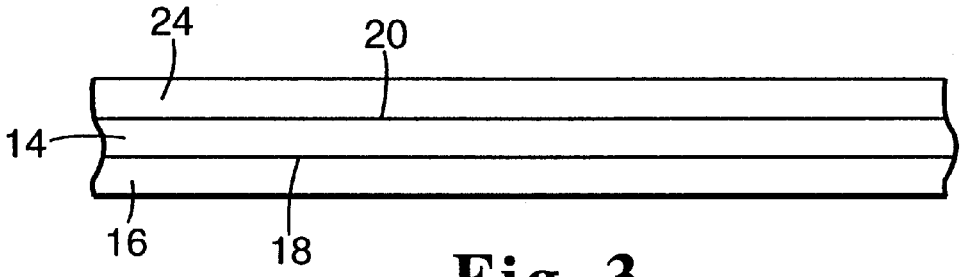
FIG. 3 is a side view of the tape of FIG. 2.

FIGS. 1–3 shows a linerless, coreless roll 10 of lint removal tape 12. The tape itself is formed of at least two layers, a backing layer 14 and an adhesive layer 16 and can be made from any known materials. The backing layer 14 has a first side 18 and a second side 20 and can be made of, for example, paper or plastic such as polypropylene. The polypropylene can be biaxially oriented polypropylene (BOPP) or simultaneously biaxially oriented polypropylene (SBOPP). The backing material can be compostible or degradable, can be colored, can be printed, and can be of different surface textures or embossed.

As best shown in FIG. 3, the adhesive layer 16 is formed on the first side 18 of the backing layer 14. It can be formed on the entire first side or the backing layer can be uncoated by adhesive along one or both side edges. Alternatively, the side edges can be adhesive coated and then detackified by using waxes, lacquers, or inks for example.

The adhesive can include hotmelt-coated formulations, transfer-coated formulations, solvent-coated formulations, and latex formulations. Adhesives useful in the preparation of lint removal tape 12 according to the present invention include all pressure sensitive adhesives. Pressure sensitive adhesives are normally tacky at room temperature and can be adhered to a surface by application of, at most, light finger pressure. Examples of adhesives useful in the invention include those based on general compositions of polyacrylate; polyvinyl ether; diene-containing rubber such as natural rubber, polyisoprene, and polyisobutylene; polychloroprene; butyl rubber; butadiene-acrylonitrile polymer; thermoplastic elastomer; block copolymers such as styrene-isoprene and styrene-isoprene-styrene block copolymers, ethylene-propylene-diene polymers, and styrene-butadiene polymer; poly-alpha-olefin; amorphous polyolefin; silicone; ethylene-containing copolymer such as ethylene vinyl acetate, ethylacrylate, and ethyl methacrylate; polyurethane;

polyamide; epoxy; polyvinylpyrrolidone and vinylpyrrolidone copolymers; polyesters; and mixtures of the above. Additionally, the adhesives can contain additives such as tackifiers, plasticizers, fillers, antioxidants, stabilizers, pigments, diffusing particles, curatives, and solvents.

A general description of useful pressure sensitive adhesives may be found in *Encyclopedia of Polymer Science and Engineering,* Vol. 13, Wiley-Interscience Publishers (New York, 1988). Additional description of useful pressure sensitive adhesives may be found in *Encyclopedia of Polymer Science and Technology,* Vol. 1, Interscience Publishers (New York, 1964).

The tape 12 is formed into a roll 10 having a plurality of wraps with the adhesive layer 16 facing outwardly by rolling the tape on only itself. No support material, such as a core, a liner, or any other material that could lend support and provide rigidity and strength to the roll of tape, is necessary. In the illustrated embodiments, none is used.

The roll 10 of lint removal tape can be used by placing the roll 10 on an applicator 30 (see FIGS. 4–6), which typically is formed of a handle portion 32 and a tape-receiving portion 34. The roll 10 is placed on the tape-receiving portion 34.

When forming a roll 10, the tape 12 is sufficiently firm, stiff, and self-supporting to obviate the need for support material. The entire roll 10, including the last wrap, is completely usable for its intended purpose of lint removal without wasting any tape. The last wrap of tape directly contacts the tape-receiving portion 34 of the applicator 30 such that the last wrap of tape is completely useable. When the last wrap of tape is removed, the applicator 30 can be replenished with another roll 10 of tape. With the roll of tape of this invention, there is no risk that any of the tape could adhere to the applicator 30 and either impair the operation of the applicator or waste tape.

The coreless roll 10 of tape could also include a third layer. A low adhesion backsize layer 24 can be formed on the second side 20 of the backing layer 14 to facilitate removing the outer wrap of tape from the roll 10 after that wrap of tape has been used and is to be discarded. Numerous other layers can be added to the tape such as primers to increase the adhesion of adhesive layer 16 to backing layer 14. Also, printed material can be located on the first side of the backing layer under the adhesive. This printed material can be advertising, instructions, or other information. Also, the tape could contain deodorants, perfumes, antistatic materials, and encapsulated cleaning chemicals. Also, the backing layer 14 can be modified such as by flame treatment, corona treatment, and roughening.

Another optional feature of the tape can be perforations 26, as shown in FIG. 2, to facilitate removing the outer wrap of tape from the roll 10 after that wrap of tape has been used and is to be discarded. The perforations 26 can be made before the tape 12 is rolled into a roll 10 or after the roll has been formed. Also, the perforations 26 on successive wraps can be located at the same or different circumferential locations on the roll 10. Alternatively, after the tape 12 is formed into a roll 10, a complete cut (not shown) can be formed through the roll to create discrete sheets and to facilitate removal of the outer wrap of tape. The complete cut could extend across the roll except for the edges or across the entire roll except for the innermost wraps.

In addition to reducing waste, the coreless feature of this invention provides a performance advantage. By eliminating any core, liner, or other backing support material, the roll is more compressible (not having any rigid support to compress). The roll is sufficiently compressible to create a plane of contact during use to remove lint. This creates a larger area on the tape to make contact with a substrate from which lint is to be removed. This compressibility is sufficient even when the tape is used on an applicator.

In making one embodiment of this invention, a master roll of 10 cm (4 in) wide tape has an embossed polypropylene backing, a low adhesion backsize (LAB) coating on one side, and a hot melt coated adhesive coating across the other side leaving uncoated edges approximately 0.62 cm (0.25 in) wide. The master roll is formed and wound in a conventional manner. The master roll is then rewound, adhesive side out, and is optionally perforated. A vacuum pulls the tape onto a mandrel during this stage and holds it in place while the appropriate length of tape is wound with the adhesive side out and converted to a coreless roll of the proper length. A turret indexes the finished wound tape. As the turret rotates, the vacuum on the original mandrel is discontinued to allow the coreless roll of tape to be removed. A second mandrel moves into place, the vacuum connects, and the process is repeated. Additional mandrels can be used, as necessary, to facilitate continuous operation.

Figure 4:
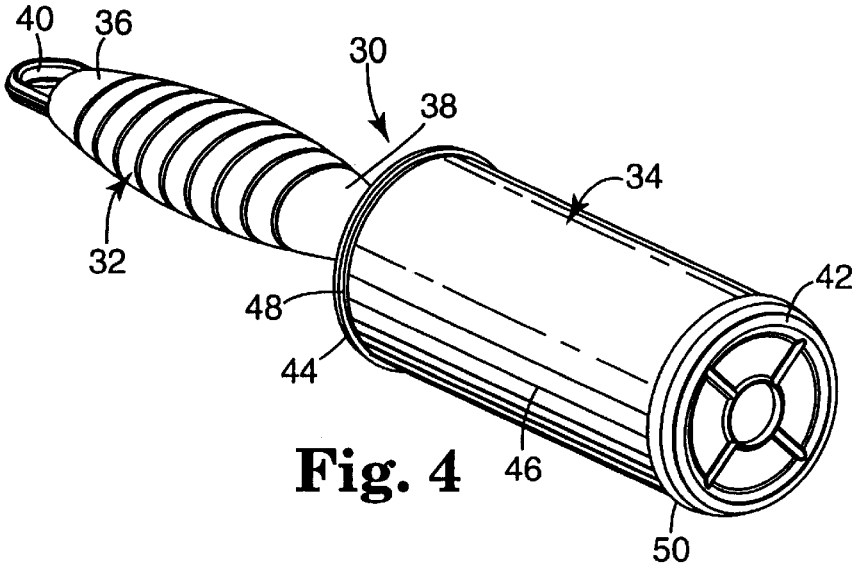
FIG. 4 is a perspective view of the applicator of the present invention.
Figure 5:
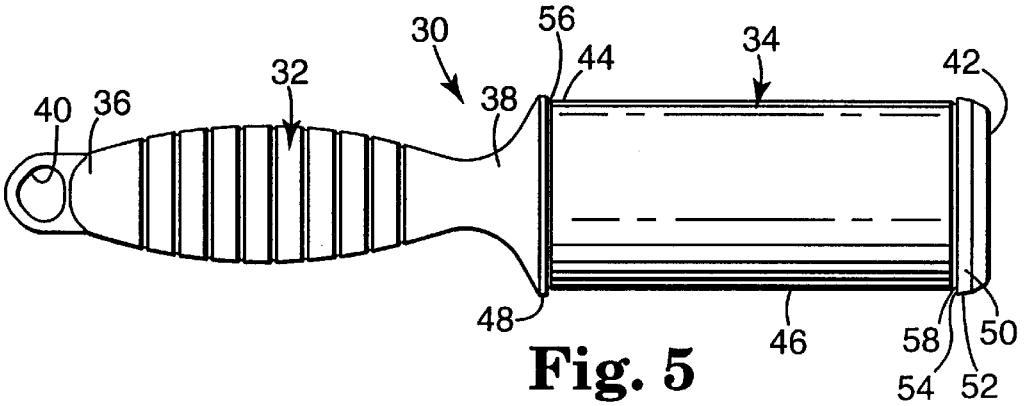
FIG. 5 is a side view of the applicator of FIG. 4.
Figure 6:
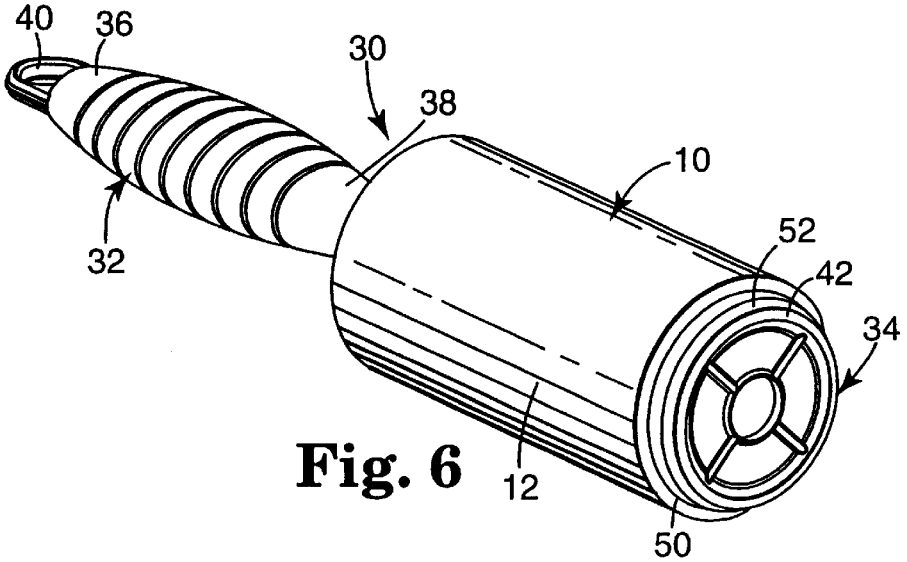
FIG. 6 is a perspective view of the roll of tape mounted on the applicator.

The invention is also a lint removal device which includes the coreless roll 10 of tape 12 and the applicator 30. As shown in FIGS. 4–6, the applicator 30 includes the handle portion 32 and the tape-receiving portion 34. Blow molding, injection molding, and other manufacturing methods can allow for a one piece construction which is simple to make and low in cost. The handle portion 32 can have any shape and can be contoured to ergodynamically fit a hand. The handle portion 32 has a free end 36 and a connecting end 38. The free end 36 can have an opening 40 to permit hanging the applicator 30 on a hook for storage.

The tape-receiving portion 34 also includes a free end 42 and a connecting end 44. The connecting end 38 of the handle portion 32 is connected to the connecting end 44 of the tape-receiving portion 34. The tape-receiving portion 34 also includes a cylindrical tape-receiving surface 46 which extends between the free end 42 and the connecting end 44. The tape-receiving surface 46 extends for the entire width of a tape roll 10 and provides support along substantially the entire surface of the tape roll. Preferably, there are no openings, gaps, or notches (such as are found in French Patent No. 1.402.540 or U.S. Pat. No. 4,422,201) on which a tape roll could catch or snag to damage the roll. Such damage could render an entire roll unusable, for example, because the roll will not rotate on the tape-receiving portion 34.

An inner lip 48 is adjacent the connecting end 44, and an outer lip 50 adjacent the free end 42 on the tape-receiving portion 34. Both lips 48, 50 extend radially beyond the tape-receiving surface 46.

Figure 7:
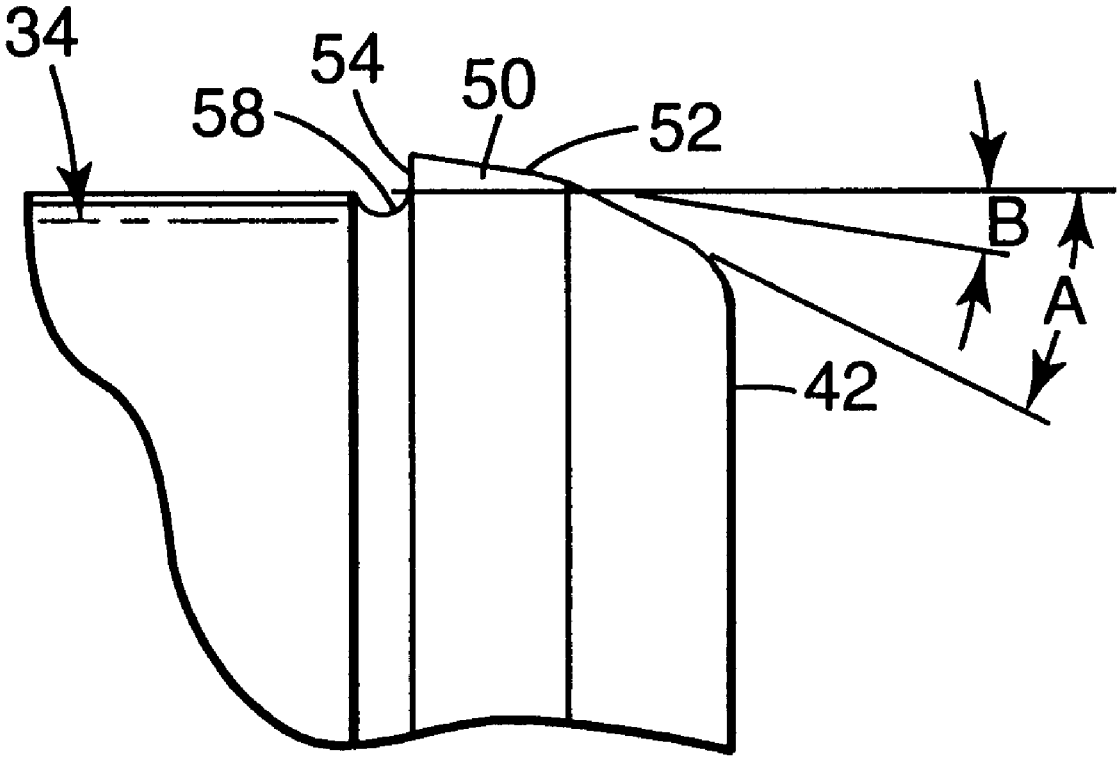
FIG. 7 is an enlarged side view of a portion of the free end of the tape-receiving portion of the applicator of FIG. 4.

The outer lip 50 has a tapered portion 52 on the side facing the free end 42 of the tape-receiving portion 34. The taper is in a direction in which the diameter increases from the free end toward the connecting end. This facilitates applying a roll on the applicator (and plays no role in removing the tape roll 10). The tapered portion can be at an angle B of from 5° to 15° with a line parallel to the tape-receiving surface 46 as shown in FIG. 7. This taper permits a coreless tape roll 10 to be applied over the outer lip 50 without damaging the inner wraps of tape and ruining the tape roll. Smaller angles tend to create tape damaging problems. Larger angles will work but very large angles, for example 25°, will not work. The taper can have a compound angle such as shown in FIG. 7 where the first angle encountered by the tape roll upon applying the tape roll onto the applicator 30 would be a large angle A which serves simply to guide the tape roll onto the applicator 30. The second angle B, shown as 9.6°, is the angle adjacent the outer lip 50 that should be within 5° to 15°.

The outer lip 50 can be perpendicular to the tape-receiving portion 34 on the side 54 facing the handle portion 32. After a tape roll 10 traverses over the outer lip 50, it is locked in place on the tape-receiving surface 46 and cannot be removed by sliding it back over the outer lip 50, as discussed below.

Because the tape roll 10 is coreless and is stretchable, it can be stretched over the slightly oversized and tapered outer lip 50 which can optionally be compressible and flexible. In one version of the invention, maximum diameter of the outer lip is more than 5% bigger than the diameter of the tape-receiving portion; the inner diameter of the tape roll is bigger than the diameter of the tape-receiving portion (which must not be too big to permit the tape roll 10 to rotate) and smaller than the maximum diameter of the outer lip. Once the roll 10 is in place, the tape recovers to its original size and resides in the recessed area of the tape-receiving surface 46 (between the inner lip 48 and the outer lip 50) which is slightly oversized to allow seating of the roll 10 of tape.

The inner and outer lips have grooves 56, 58 in the tape-receiving surface 46 to hold the tape roll in place so that the tape roll cannot be removed except by dispensing the total roll, that is all of the sheets of a coreless roll (or compressing the outer lip 50). The grooves 56, 58 extend completely around the tape-receiving surface 46 and prevent the tape roll 10 from bending upward over the respective inner and outer lips 48, 50. The grooves cause the tape roll 10 to bend into the groove when forced toward the lips 48, 50 and retains the tape 12 in proper alignment on the tape-receiving surface 46. Typically, up to eight layers of tape would be retained by the grooves 56, 58. Attempts to remove the tape roll are merely unsuccessful; the tape is not damaged. Without the grooves 56, 58, only about two to three sheets of a coreless roll would be retained by the inner and outer lips 48, 50. Without the grooves, attempts to remove the tape cause the tape to ball up, damaging the tape roll 10 and preventing it from rotating, rendering it useless. (A typical roll on a fiber core could not be used in this roller design due to its inflexible core.)

The applicator 30 could be used with a cored tape roll only if the core is compressible. However, the compressible core would remain on the tape-receiving portion 34 after the tape is completely dispensed. The applicator would consequently not be reusable unless the core was cut off. Combination of the applicator with a coreless tape allows for easy reuse.

Various changes and modifications can be made in the invention without departing from the scope or spirit of the invention. For example, the tape can be used for purposes other than lint removal. Also, the tape-receiving surface need not be cylindrical. It could be formed of planar or curved sides meeting in edges which assist in holding the tape roll in position.

We claim:

1. An applicator for a lint removal device comprising:

a handle portion having a free end and a connecting end; and a tape-receiving portion having a free end and a connecting end wherein the handle portion connecting end is connected to the tape-receiving portion connecting end, wherein the tape-receiving portion further comprises:

a cylindrical tape-receiving surface;

an inner lip adjacent the handle portion which extends radially beyond the tape-receiving surface;

an outer lip adjacent the tape-receiving portion free end and which extends radially beyond the tape-receiving surface, wherein the outer lip is tapered in a direction toward the tape-receiving portion free end to facilitate applying a roll on the applicator; and a groove formed adjacent the outer lip on the side facing the handle portion, wherein after a roll of tape traverses over the outer lip it is locked in place on the tape-receiving surface by the groove and cannot be removed by sliding it back over the outer lip.

2. The applicator of claim 1 wherein the outer lip is substantially inflexible such that in order for the tape-receiving surface to receive a roll of tape that is slid over the outer lip the inside surface of the roll of tape would need to be compressible.

3. The applicator of claim 1 wherein the outer lip is perpendicular to the tape-receiving portion on the side facing the handle portion.

4. The applicator of claim 1 wherein the outer lip has a tapered portion on the side facing the free end of the tape-receiving portion to permit a coreless roll of tape to be applied over the outer lip without damaging the inner wraps of tape and ruining the tape roll.

5. The applicator of claim 4 wherein the tapered portion is at an angle of from 5° to 15° with a line parallel to the tape-receiving surface.

6. The applicator of claim 1 which is blow molded and formed of a one piece construction.

7. The applicator of claim 1 wherein the handle portion is contoured to ergodynamically fit a hand.

8. The applicator of claim 1 wherein the handle portion has an opening at the free end to permit hanging the handle on a hook for storage.

9. The applicator of claim 1 wherein the outer lip is flexible to permit a roll of tape to be slid over the outer lip onto the tape-receiving surface.

10. The applicator of claim 1 further comprising a groove formed adjacent the inner lip on the side facing the tape-receiving portion free end.

* * * * *

UNITED STATES PATENT AND TRADEMARK OFFICE

CERTIFICATE OF CORRECTION

PATENT NO. : 5,940,921
DATED : August 24, 1999
INVENTOR(S) : Thomas L. Wood and Raymond D. Zachrison It is certified that error appears in the above-identified patent and that said Letters Patent is hereby corrected as shown below:

Title page,
Under "U.S. patent documents", the following references shoud be added:

| | | | |
|---|---|---|---|
| -- D 341,256 | 11/1993 | Brazis et al. | D4/122 -- |
| -- 5,148,571 | 9/1992 | Brazis et al. | 15/104.022 --; and |

Title page,
Under "Foreign Patent Documents," the following references should be added:

| | | |
|---|---|---|
| -- 1402540 | 5/1965 | France --. |

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*